US008818014B2

(12) United States Patent
Imanishi et al.

(10) Patent No.: US 8,818,014 B2
(45) Date of Patent: Aug. 26, 2014

(54) SOUND PRODUCTION COMPONENT

(71) Applicant: Murata Manufacturing Co., Ltd., Nagaokakyo (JP)

(72) Inventors: Toshio Imanishi, Nagaokakyo (JP); Yoshihiro Sonoda, Nagaokakyo (JP)

(73) Assignee: Murata Manufacturing Co., Ltd., Nagaokakyo-Shi, Kyoto-fu (JP)

( * ) Notice: Subject to any disclaimer, the term of this patent is extended or adjusted under 35 U.S.C. 154(b) by 0 days.

(21) Appl. No.: 13/655,821

(22) Filed: Oct. 19, 2012

(65) Prior Publication Data

US 2013/0039516 A1 Feb. 14, 2013

Related U.S. Application Data

(63) Continuation of application No. PCT/JP2011/061982, filed on May 25, 2011.

(30) Foreign Application Priority Data

Jun. 7, 2010 (JP) ..... 2010-129657

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 25/00* | (2006.01) |

(52) U.S. Cl.

USPC ..... 381/398; 381/190; 381/431

(58) Field of Classification Search

CPC ..... H04R 7/16; H04R 7/18; H04R 7/20; H04R 17/00

USPC ..... 381/190, 398, 431, 150, 433; 181/171–172

See application file for complete search history.

(56) References Cited

U.S. PATENT DOCUMENTS

| | | | | |
|---|---|---|---|---|
| 6,960,868 | B2 | 11/2005 | Ishimasa et al. | |
| 6,978,032 | B2 | 12/2005 | Ogura et al. | |
| 8,014,547 | B2 | 9/2011 | Ogura et al. | |
| 2002/0186860 | A1 * | 12/2002 | Ogura et al. | 381/398 |

FOREIGN PATENT DOCUMENTS

| | | | |
|---|---|---|---|
| CN | 1422102 | A | 6/2003 |
| CN | 1536931 | A | 10/2004 |
| CN | 101112119 | A | 1/2008 |
| JP | 60-55193 | | 4/1985 |
| JP | 62-85091 | | 5/1987 |

(Continued)

OTHER PUBLICATIONS

PCT/2011/061982 Written Opinion dated Jun. 17, 2011.

(Continued)

*Primary Examiner* — Matthew Eason

(74) *Attorney, Agent, or Firm* — Dickstein Shapiro LLP

(57) ABSTRACT

A sound production component that includes a vibration element, a support member, and a connection part. The vibration element includes a polygonal vibration plate and an electromechanical conversion element attached to the vibration plate. The connection part connects an entire periphery of the vibration plate to the support member. At least a portion of the connection part has a curved shape. The length of a portion of the connection part which connects each corner of the vibration plate and the support member is shorter than the length of a portion of the connection part which connects a central portion of each side edge of the vibration plate and the support member.

12 Claims, 6 Drawing Sheets

(56) References Cited

FOREIGN PATENT DOCUMENTS

| | | | |
|---|---|---|---|
| JP | S63-068298 | U | 5/1988 |
| JP | S 068298 | | 5/1988 |
| JP | 2001-339791 | A | 12/2001 |
| JP | 2006-303770 | A | 11/2006 |
| WO | WO-2007-083497 | A1 | 7/2007 |
| WO | WO-2007-097077 | A1 | 8/2007 |

OTHER PUBLICATIONS

PCT/2011/061982 International Search Report dated Jun. 17, 2011.

* cited by examiner

SOUND PRODUCTION COMPONENT

CROSS REFERENCE TO RELATED APPLICATIONS

The present application is a continuation of International application No. PCT/JP2011/061982, filed May 25, 2011, which claims priority to Japanese Patent Application No. 2010-129657, filed Jun. 7, 2010, the entire contents of each of which are incorporated herein by reference.

FIELD OF THE INVENTION

The present invention relates to a sound production component. In particular, the present invention relates to a sound production component using a piezoelectric element.

BACKGROUND OF THE INVENTION

In the related art, sound production components using piezoelectric elements have been proposed, for example, in Patent Literature 1 and 2 described below. FIG. 14 is a schematic cross-sectional view of a portion of a piezoelectric sound production component described in Patent Literature 1. As shown in FIG. 14, the piezoelectric sound production component 100 includes a piezoelectric vibrator 101. The piezoelectric vibrator 101 includes a disk-shaped vibration plate 101*a* and a piezoelectric element 101*b* attached to the vibration plate 101*a*. The vibration plate 101*a* is attached at the entire circumference thereof to a case 103 through a support member 102.

In the piezoelectric sound production component 100, the support member 102 is formed in a curved shape. Thus, in the piezoelectric sound production component 100, the piezoelectric vibrator 101 can be greatly displaced. Therefore, in the piezoelectric sound production component 100, high output can be obtained.

Meanwhile, Patent Literature 2 states that a vibration plate is formed into a rectangular shape. When the vibration plate has a rectangular shape, the vibration amplitude of the vibration plate is determined by the length of the diagonal line. Thus, when the rectangular vibration plate is used, the equal vibration amplitude can be obtained with a vibration plate smaller than that when a circular vibration plate is used. Therefore, a piezoelectric sound production component can be reduced in size. In other words, when the vibration plate is formed into a rectangular shape, a piezoelectric sound production component having a small size but high output can be realized.

PTL 1: Japanese Unexamined Patent Application Publication No. 2001-339791

PTL 2: International Publication No. 2007/097077A1

SUMMARY OF THE INVENTION

However, in recent years, size reduction and output increase of sound production components have been increasingly demanded.

The present invention is made in view of this point, and it is an object of the present invention to provide a sound production component having a small size but high output.

A sound production component according to the present invention includes a vibration element, a support member, and a connection part. The vibration element includes a polygonal vibration plate and an electromechanical conversion element. The electromechanical conversion element is attached to the vibration plate. The electromechanical conversion element expands and contracts by a voltage being applied thereto. The connection part connects an entire periphery of the vibration plate to the support member. At least a portion of the connection part has a curved shape. A length of a portion of the connection part which connects a corner of the vibration plate and the support member is shorter than a length of a portion of the connection part which connects a central portion of a side edge of the vibration plate and the support member.

It should be noted that in the present invention, the "length of the connection part" means the length of a portion of the connection part which is provided between the vibration plate and the support member. For example, when a portion of the connection part is located on the support member, the length of the portion of the connection part which is located on the support member is not included in the "length of the connection part".

In a specific aspect of the sound production component according to the present invention, a length of the connection part gradually changes between the portion connected to the corner of the vibration plate and the portion connected to the central portion of the side edge of the vibration plate. According to this configuration, the vibration amplitude of the vibration element can be increased. Thus, further increase of output can be achieved.

In another specific aspect of the sound production component according to the present invention, a length of the connection part monotonically increases from the portion connected to the corner of the vibration plate toward the portion connected to the central portion of the side edge of the vibration plate. According to this configuration, the vibration amplitude of the vibration element can be further increased. Thus, further increase of output can be achieved.

In another specific aspect of the sound production component according to the present invention, the length of the portion of the connection part which connects the corner of the vibration plate and the support member is zero. According to this configuration, the vibration amplitude of the vibration element can be further increased. Thus, further increase of output can be achieved.

In still another specific aspect of the sound production component according to the present invention, the vibration plate has a rectangular shape.

In still another specific aspect of the sound production component according to the present invention, the electromechanical conversion element is a piezoelectric element.

In still another specific aspect of the sound production component according to the present invention, the vibration plate and the connection part are integrally formed.

In still another specific aspect of the sound production component according to the present invention, the vibration plate is formed from a resin film.

In the present invention, the length of the portion of the connection part which connects the corner of the vibration plate and the support member is shorter than the length of the portion of the connection part which connects the central portion of the side edge of the vibration plate and the support member. Thus, the vibration amplitude of the vibration element can be increased. Thus, according to the present invention, a sound production component having a small size but high output can be provided.

DETAILED DESCRIPTION OF THE PREFERRED EMBODIMENTS

First Embodiment

Hereinafter, a preferred embodiment implementing the present invention will be described with a piezoelectric sound production component 1 shown in FIG. 1, as an example. However, the piezoelectric sound production component 1 is merely illustrative. A piezoelectric sound production component according to the present invention is not limited to the piezoelectric sound production component 1.

Figure 1:
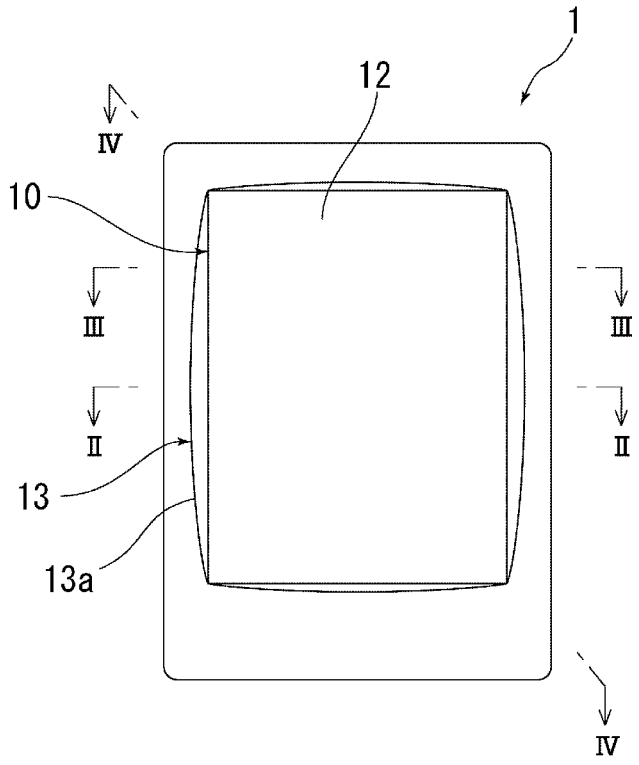
FIG. 1 is a schematic plan view of a piezoelectric sound production component according to a first embodiment.
Figure 2:
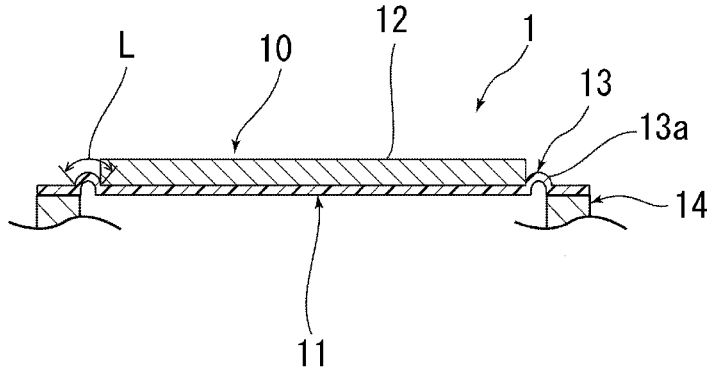
FIG. 2 is a schematic cross-sectional view taken along the line II-II in FIG. 1.
Figure 3:
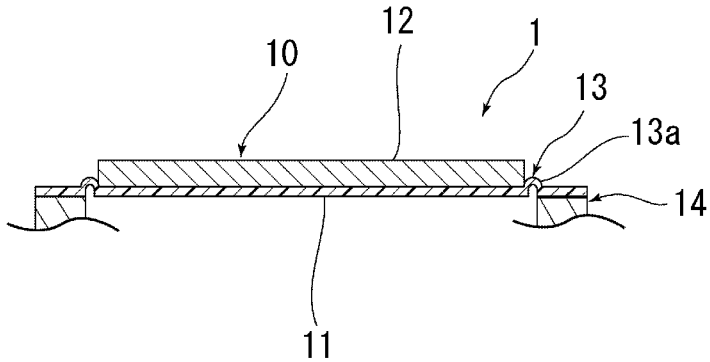
FIG. 3 is a schematic cross-sectional view taken along the line III-III in FIG. 1.
Figure 4:
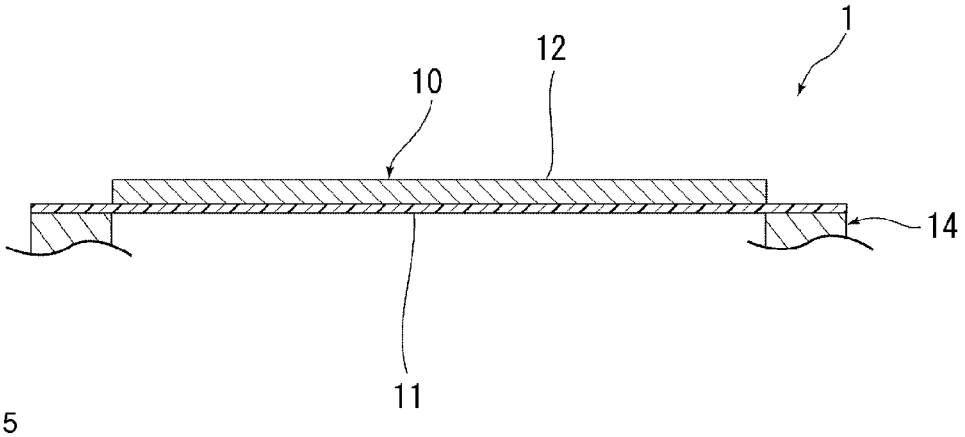
FIG. 4 is a schematic cross-sectional view taken along the line IV-IV in FIG. 1.

FIG. 1 is a schematic plan view of a piezoelectric sound production component according to a first embodiment. FIG. 2 is a schematic cross-sectional view taken along the line II-II in FIG. 1. FIG. 3 is a schematic cross-sectional view taken along the line III-III in FIG. 1. FIG. 4 is a schematic cross-sectional view taken along the line IV-IV in FIG. 1.

As shown in FIGS. 1 to 4, the piezoelectric sound production component 1 of this embodiment includes a piezoelectric vibration element 10. As shown in FIGS. 2 to 4, the piezoelectric vibration element 10 includes a vibration plate 11 and a piezoelectric element 12 as an electromechanical conversion element which expands and contracts by a voltage being applied thereto.

The vibration plate 11 is formed in a polygonal shape. Specifically, in this embodiment, the vibration plate 11 is formed in a rectangular shape. The vibration plate 11 is formed by an elastic member having elasticity. Thus, the vibration plate 11 is vibratable by stress being applied thereto. The vibration plate 11 can be formed, for example, from resin, metal, or ceramic. Among them, the vibration plate 11 is preferably formed from resin. This is because with resin, thinning and molding are easy and the vibration plate 11 is easily formed with low elasticity such that the vibration plate 11 is vibratable at a low frequency. Examples of resin include polyethylene terephthalate (PET), polyethylene naphthalate (PEN), polyphenylene sulfide (PPS), polyetherimide (PEI), and polyimide (PI).

It should be noted that the thickness of the vibration plate 11 is not particularly limited, and can be, for example, about 10 μm to 100 μm.

The piezoelectric element 12 is attached on the vibration plate 11. When a voltage is applied to the piezoelectric element 12 and the piezoelectric element 12 expands and contracts or flexurally vibrates, the piezoelectric vibration element 10 vibrates.

The method of attaching the piezoelectric element 12 on the vibration plate 11 is not particularly limited. For example, the piezoelectric element 12 can be attached on the vibration plate 11 by using an adhesive.

Figure 5:
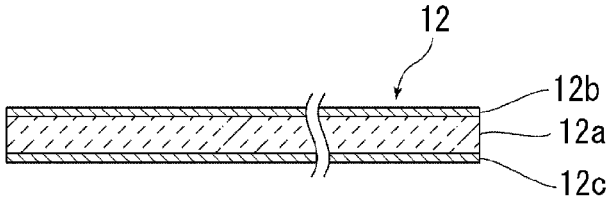
FIG. 5 is a schematic cross-sectional view of a piezoelectric element.

FIG. 5 is a schematic cross-sectional view of the piezoelectric element 12. As shown in FIG. 5, the piezoelectric element 12 includes a piezoelectric substrate 12*a* and a pair of electrodes 12*b* and 12*c* which apply a voltage to the piezoelectric substrate 12*a*. In this embodiment, the electrodes 12*b* and 12*c* are formed on both principal surfaces of the piezoelectric substrate 12*a*.

The piezoelectric substrate 12*a* can be formed from an appropriate piezoelectric material. Specifically, the piezoelectric substrate 12*a* can be formed from lead zirconate titanate ceramic or the like. In addition, the piezoelectric substrate 12*a* may have a lamination structure.

The electrodes 12*b* and 12*c* can be formed from an appropriate conductive material. Specifically, the electrodes 12*b* and 12*c* can be formed, for example, from metal such as Al, Ag, Au, Pt, Ni, Cr, and Cu, or an alloy including one or more of these metals, such as Ag—Pd alloy.

It should be noted that when the vibration plate 11 has conductivity, the piezoelectric element 12 may be attached on the vibration plate 11 through an insulating member.

As shown in FIGS. 2 and 3 and the like, the piezoelectric vibration element 10 is attached to a casing 14 as a support member through a connection part 13. Specifically, the piezoelectric vibration element 10 is attached to the casing 14 by the vibration plate 11 being connected at the entire periphery thereof to the casing 14 through the connection part 13.

The casing 14 is formed, for example, from a hard material such as stainless steel.

The connection part 13 connects the casing 14 and the vibration plate 11 and serves to support the piezoelectric vibration element 10. In addition, the connection part 13 has elasticity, and vibrates with vibrations of the piezoelectric vibration element 10. Similarly to the vibration plate 11, the connection part 13 can be formed, for example, from resin, metal, or ceramic. Among them, the connection part 13 is preferably formed from resin. This is because with resin, thinning and molding are easy and the connection part 13 is easily formed with low elasticity such that the vibration plate 11 is vibratable at a low frequency. Examples of resin include polyethylene terephthalate (PET), polyethylene naphthalate (PEN), polyphenylene sulfide (PPS), polyetherimide (PEI), and polyimide (PI).

It should be noted that the connection part 13 may be formed independently of the vibration plate 11, but the connection part 13 and the vibration plate 11 are integrally formed in this embodiment.

At least a portion of the connection part 13 is formed in a curved shape. Specifically, a portion of the connection part 13 which is located between the vibration plate 11 and the casing 14 is formed in a curved shape. The length L of the curved portion 13*a* (see FIG. 2) is not uniform around the vibration plate 11. The length of a portion of the curved portion 13*a* which connects each corner of the vibration plate 11 and the casing 14 is shorter than the length of a portion of the curved portion 13*a* which connects a central portion of each side edge of the vibration plate 11 and the casing 14. In other words, the curvature radius of the portion of the curved portion 13*a* which connects each corner of the vibration plate 11 and the casing 14 is shorter than the curvature radius of the portion of the curved portion 13*a* which connects the central portion of each side edge of the vibration plate 11 and the casing 14. More specifically, the length L of the curved portion 13*a* gradually changes between the portion connected to each corner of the vibration plate 11 and the portion connected to the central portion of each side edge of the vibration plate 11. The length L of the curved portion 13*a* monotonically increases from the portion connected to each corner of the vibration plate 11 toward the portion connected to the central portion of each side edge of the vibration plate 11. In other words, the length L of the curved portion 13*a* gradually increases from the portion connected to each corner of the vibration plate 11 toward the portion connected to the central portion of each side edge of the vibration plate 11, and is at its maximum at the central portion of each side edge of the vibration plate 11.

It should be noted that in this embodiment, as shown in FIG. 4, the curved portion 13*a* is not provided at each corner of the vibration plate 11, and the length of the connection part 13 is zero there.

The maximum curvature radius of the curved portion 13*a* can be, for example, about 100 μm to 1000 μm.

Next, an operation of the piezoelectric sound production component 1 of this embodiment will be described.

When a voltage is applied to the piezoelectric element 12, the piezoelectric element 12 expands and contracts or flexurally vibrates. Specifically, in this embodiment, the piezoelectric element 12 flexurally vibrates. With this motion of the piezoelectric element 12, the vibration plate 11 vibrates, and as a result, sound is produced. The frequency of the produced sound changes mainly in response to the frequency of the vibrations of the vibration plate 11. In addition, as the vibration amplitude of the vibration plate 11 increases, the sound pressure increases, and loud sound is produced. In other words, output is increased.

Figure 6:
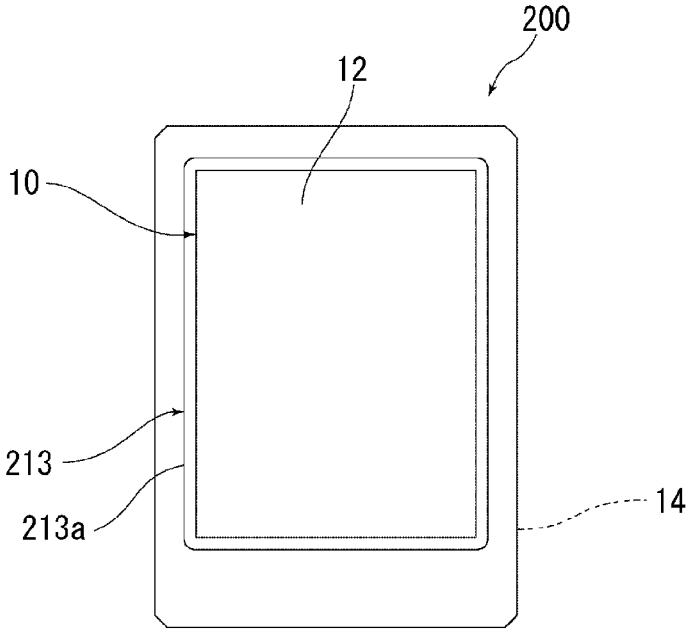
FIG. 6 is a schematic plan view of a piezoelectric sound production component according to a comparative example.

FIG. 6 is a schematic plan view of a piezoelectric sound production component according to a comparative example. It should be noted that in a description of the piezoelectric sound production component 200 according to the comparative example shown in FIG. 6, members having substantially common functions to those in the first embodiment are designated by common reference sings, and the description thereof is omitted.

The piezoelectric sound production component 200 according to the comparative example shown in FIG. 6 differs from the piezoelectric sound production component 1 of the first embodiment described above, in that the curvature radius of a curved portion 213*a* of a connection part 213 is uniform. In other words, in the piezoelectric sound production component 200, the length of a portion of the curved portion 213*a* which connects each corner of the vibration plate 11 and the casing 14 is equal to the length of a portion of the curved portion 213*a* which connects a central portion of each side edge of the vibration plate 11 and the casing 14.

Figure 7:
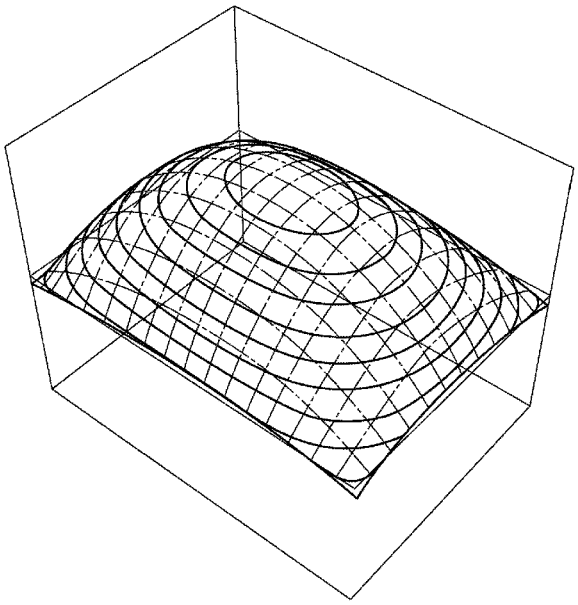
FIG. 7 is a schematic diagram for illustrating a displaced shape of the piezoelectric sound production component according to the comparative example.

FIG. 7 shows a result of simulation of a displaced shape of the piezoelectric sound production component 200 of FIG. 6. It should be noted that the result shown in FIG. 7 schematically shows the vibration plate when the amplitude of first resonance is at its maximum.

Figure 8:
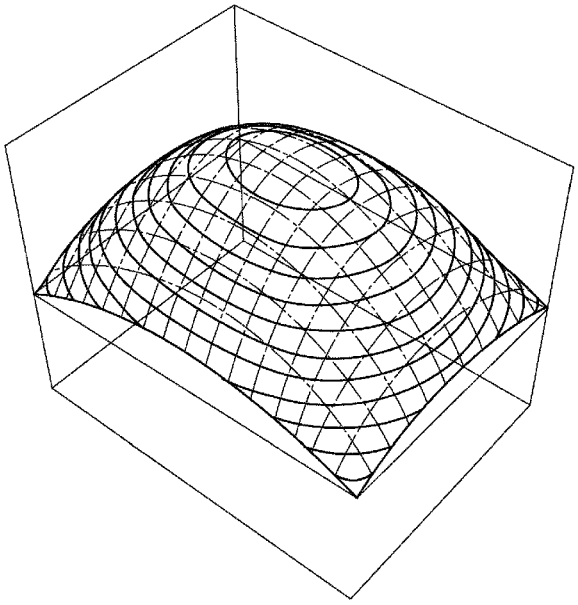
FIG. 8 is a schematic diagram for illustrating a displaced shape of a piezoelectric sound production component according to an example.

Further, FIG. 8 shows a result of simulation of a displaced shape of a piezoelectric sound production component according to an example, which has the same configuration as that of the embodiment described above with reference to FIGS. 1 to 4. It should be noted that the result shown in FIG. 8 schematically shows the vibration plate when the amplitude of first resonance is at its maximum.

The example and the comparative example are the same in configuration, except whether or not the curvature radius of the curved portion is uniform.

The intervals between contour lines in FIG. 8 are smaller than the intervals between contour lines in FIG. 7. Thus, from the results shown in FIGS. 7 and 8, it appears that the maximum amplitude of the first resonance is larger in the example in which the length of the portion of the curved portion 13*a* which connects each corner of the vibration plate 11 and the casing 14 is shorter than the length of the portion of the curved portion 13*a* which connects the central portion of each side edge of the vibration plate 11 and the casing 14.

Figure 9:
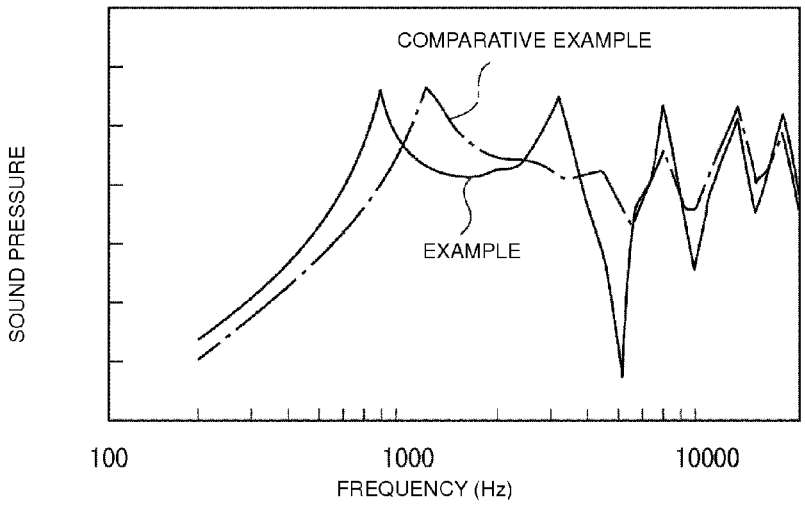
FIG. 9 is a graph showing sound pressure of the piezoelectric sound production component according to the example and sound pressure of the piezoelectric sound production component according to the comparative example.

FIG. 9 is a graph showing sound pressure of the piezoelectric sound production component according to the example and sound pressure of the piezoelectric sound production component according to the comparative example.

From the result shown in FIG. 9, it appears that the frequency of the first resonance is lower in the example but the sound pressure at each frequency of the first resonance in the example is equal to that in the comparative example. Here, in order to obtain equal sound pressure, larger amplitude is needed when the frequency is lower. Thus, from the result shown in FIG. 9 as well, it appears that the maximum amplitude of the first resonance is larger in the example than in the comparative example.

As described above, it is recognized that large amplitude can be realized by making the length of the portion of the curved portion 13*a* which connects each corner of the vibration plate 11 and the casing 14 shorter than the length of the portion of the curved portion 13*a* which connects the central portion of each side edge of the vibration plate 11 and the casing 14. Therefore, the piezoelectric sound production component 1 having a small size but high output can be realized.

This reason is thought to be that as seen from the result shown in FIG. 8 as well, by firmly holding the four corners of the vibration plate 11 and decreasing the force of holding the other portions to be less than the force of holding the four corners, the central portion of each side edge of the vibration plate 11 also vibrates, and the vibration amplitude also increases as a whole.

Thus, it is thought that it is preferred that the curved portion 13*a* is not provided at each corner of the vibration plate 11 and the length of the connection part 13 is zero there as in this embodiment. In this case, this is because it is thought that since the corners of the vibration plate 11 are more firmly fixed, larger vibration amplitude is obtained.

Meanwhile, it is thought that when the force of holding the four corners and the force of holding the central portion of each side edge are equal to each other as in the comparative example, if holding is relatively large, vibrations of the central portion of each side edge of the vibration plate are inhibited, and if the holding force is relatively small, the vibration amplitude of the four corners shifts toward the negative direction due to the received pressure of air at sound production, and thus the vibration amplitude decreases as a whole.

In light of realizing higher output, it is preferred that the length L of the curved portion 13*a* gradually changes between the portion connected to each corner of the vibration plate 11 and the portion connected to the central portion of each side edge of the vibration plate 11. In addition, it is preferred that the length L of the curved portion 13*a* monotonically increases from the portion connected to each corner of the vibration plate 11 toward the portion connected to the central portion of each side edge of the vibration plate 11. Further, in this case, the deformed shape of the piezoelectric vibration element 10 can be more preferably adjusted. Therefore, unnecessary vibrations are reduced, and an effect of realizing higher sound quality, an effect of enhancing vibration efficiency, and an effect of reducing distortion are also provided.

Hereinafter, other examples of the preferred embodiment implementing the present invention will be described. In the following description, members having substantially common functions to those in the first embodiment described above are designated by common reference sings, and the description thereof is omitted.

Second Embodiment

Figure 10:
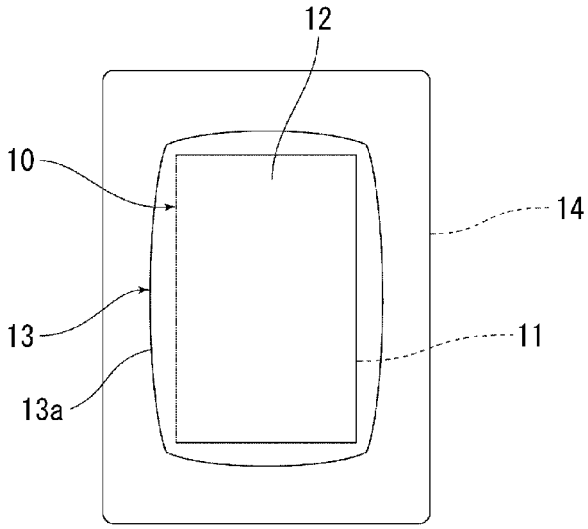
FIG. 10 is a schematic plan view of a piezoelectric sound production component according to a second embodiment.

FIG. 10 is a schematic plan view of a piezoelectric sound production component according to a second embodiment.

In the first embodiment described above, the example has been described in which as shown in FIG. 4, the curved portion 13*a* is not provided at each corner of the vibration plate 11 and the length of the connection part 13 is zero there. However, the present invention is not limited to this configuration. For example, as shown in FIG. 10, each corner of the vibration plate 11 may be connected to the casing 14 through the curved portion 13*a*.

Third Embodiment

Figure 11:
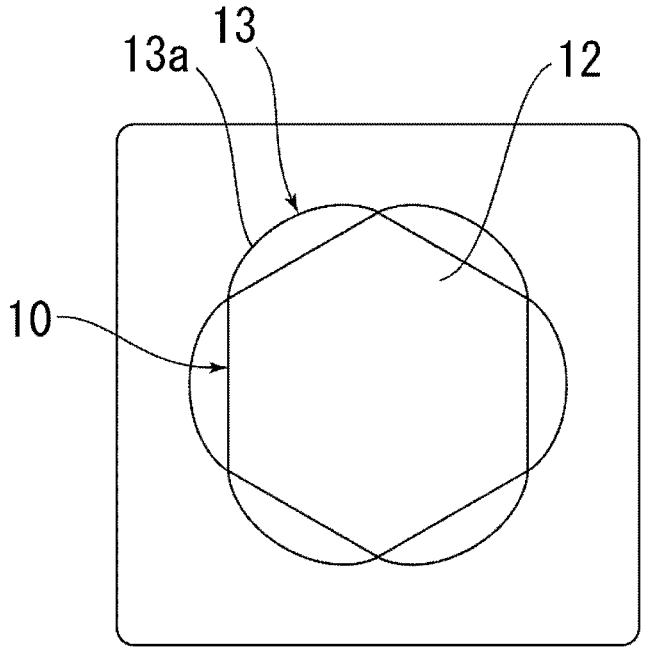
FIG. 11 is a schematic plan view of a piezoelectric sound production component according to a third embodiment.

FIG. 11 is a schematic plan view of a piezoelectric sound production component according to a third embodiment.

In the embodiments described above, the example has been described in which the vibration plate 11 has a rectangular shape. However, in the present invention, the vibration plate does not necessarily have to have a rectangular shape. The vibration plate 11 suffices to have a polygonal shape, and may have, for example, a hexagonal shape as shown in FIG. 11.

Further, in this case, the piezoelectric element 12 may also have a hexagonal shape similarly to the vibration plate 11. It should be noted that in the present invention, a polygon refers to a figure having three or more vertices. Thus, a polygon includes a triangle.

The shape of the piezoelectric element 12 does not necessarily have to be the same as the shape of the vibration plate 11. The shape of the piezoelectric element 12 may be different from the shape of the vibration plate 11. In other words, in the present invention, the shape of the piezoelectric element is not particularly limited.

In the first to third embodiments described above, the case has been described in which the curved portion 13*a* of the connection part 13 has a substantially semicircular shape. However, the shape of the curved portion 13*a* is not limited to the substantially semicircular shape. The curved portion 13*a* may have, for example, a shape having a plurality of inflection points. Specifically, the curved portion 13*a* may have, for example, an S shape.

Fourth and Fifth Embodiments

Figure 12:
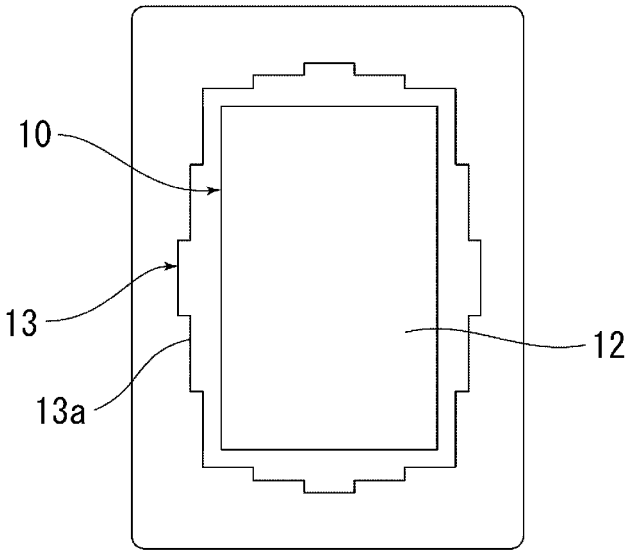
FIG. 12 is a schematic plan view of a piezoelectric sound production component according to a fourth embodiment.
Figure 13:
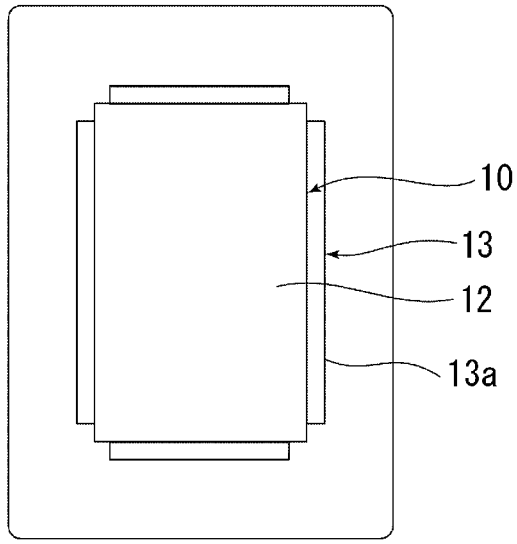
FIG. 13 is a schematic plan view of a piezoelectric sound production component according to a fifth embodiment.
Figure 14:
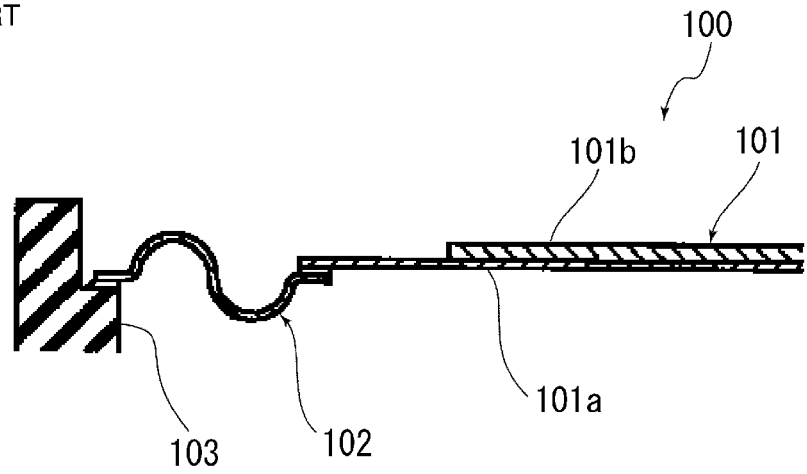
FIG. 14 PRIOR ART
FIG. 14 is a schematic cross-sectional view of a portion of a piezoelectric sound production component described in Patent Literature 1.

FIG. 12 is a schematic plan view of a piezoelectric sound production component according to a fourth embodiment. FIG. 13 is a schematic plan view of a piezoelectric sound production component according to a fifth embodiment.

In the first embodiment described above, the example has been described in which the length of the curved portion 13*a* gradually and monotonically increases between the portion connected to each corner of the vibration plate 11 and the portion connected to the central portion of each side edge of the vibration plate. However, the present invention is not particularly limited, as long as the length of the portion of the connection part which connects each corner of the vibration plate and the support member is shorter than the length of the portion of the connection part which connects the central portion of each side edge of the vibration plate and the support member.

For example, as shown in FIG. 12, the length of the curved portion 13*a* may nonlinearly and monotonically increase from the corner side toward the central portion side. In addition, when the length of the curved portion 13*a* on the central portion side is longer than the length of the curved portion 13*a* on the corner side, a portion longer than the central portion may be present in a region of the curved portion 13*a* between the corner side and the central portion side.

Further, for example, as shown in FIG. 13, the curved portion 13*a* is not provided on each corner side, and a curved portion 13*a* having a substantially uniform length may be provided at the other portion.

REFERENCE SIGNS LIST

1 piezoelectric sound production component
10 piezoelectric vibration element
11 vibration plate
12 piezoelectric element
12*a* piezoelectric substrate
12*b*, 12*c* electrode
13 connection part
13*a* curved portion
14 casing

The invention claimed is:

1. A sound production component comprising:
a planar vibration plate having a straight side edge which extends between two corners of the vibration plate;
an electromechanical conversion element attached to the vibration plate and which expands and contracts in response to a voltage applied thereto;
a support member; and
a connector which connects the vibration plate to the support member and of which at least a segment thereof has an arcuate shape as viewed in a direction perpendicular to the plane of the vibration plate, wherein an arc length of a first portion of the connector which connects a point adjacent one of the corners of the vibration plate to the support member is shorter than an arc length of a second portion of the connector which connects a central portion of a side edge of the vibration plate to the support member.

2. The sound production component according to claim 1, wherein the vibration plate has a polygonal shape.

3. The sound production component according to claim 2, wherein the vibration plate has a rectangular shape.

4. The sound production component according to claim 2, wherein the vibration plate has a hexagonal shape.

5. The sound production component according to claim 1, wherein the connector extends between and is connected to at least substantially the entire side edge.

6. The sound production component according to claim 5, wherein the connector does not extend to the two corners.

7. The sound production component according to claim 1, wherein the electromechanical conversion element is a piezoelectric element.

8. The sound production component according to claim 1, wherein the vibration plate and the connector are integral.

9. The sound production component according to claim 1, wherein the vibration plate is a resin film.

10. The sound production component according to claim 1, wherein the connector connects an entire periphery of the vibration plate to the support member.

11. The sound production component according to claim 5, wherein the entire portion of the connector connected to the side edge is arcuate in shape as viewed along a plane perpendicular to the plane of the vibration plate and the arc length of the connector, as measured in a direct perpendicular to the side edge increases gradually from the two corners to the center of the side edge.

12. The sound production component according to claim 5, wherein the entire portion of the connector connected to the side edge is arcuate in shape as viewed along a plane perpendicular to the plane of the vibration plate and the arc length of the connector, as measured in a direction perpendicular to the side edge, increases in a stepped manner between the corners and the center of the side edge.

* * * * *